United States Patent [19]

Richard

[11] Patent Number: 4,625,354

[45] Date of Patent: Dec. 2, 1986

[54] BRIDGE WITH PREFABRICATED SECTIONS AND WITH EXTERNAL PRESTRESSING BY CABLES

[75] Inventor: Pierre Richard, Neuilly S. Seine, France

[73] Assignee: Bouygues, France

[21] Appl. No.: 609,734

[22] Filed: May 14, 1984

[30] Foreign Application Priority Data

May 16, 1983 [FR] France ..... 83 08058

[51] Int. Cl.[4] ..... E01D 7/00

[52] U.S. Cl. ..... 14/73; 14/6; 14/18; 52/227; 52/226

[58] Field of Search ..... 14/3-6, 14/9-15, 73, 17, 18; 52/226, 227, 691, 723, 223 R

[56] References Cited

U.S. PATENT DOCUMENTS 3,906,571 9/1975 Zetlin ..... 14/6 X

FOREIGN PATENT DOCUMENTS 1176071 10/1984 Canada ..... 14/6

1245408 7/1967 Fed. Rep. of Germany ..... 14/6

*Primary Examiner*—Stephen J. Novosad

*Assistant Examiner*—John F. Letchford

*Attorney, Agent, or Firm*—McCormick, Paulding & Huber

[57] ABSTRACT

A bridge has prefabricated sections and is prestressed externally of the concrete of the sections by cables. Each section has upper and lower decks, interbraced by longitudinal oblique webs which form dihedrons. Certain dihedrons are closed by transverse panels. The panels assure the desired deviations of the prestressing cables as well as their anchoring.

10 Claims, 18 Drawing Figures

BRIDGE WITH PREFABRICATED SECTIONS AND WITH EXTERNAL PRESTRESSING BY CABLES

BACKGROUND OF INVENTION

The invention concerns a new bridge structure with prefabricated sections and prestressed together externally by cables, this signifying that the cables pass externally of the concrete of the structure.

This type of bridge is already known, as described for example in the French Pat. No. 80 24984 where the running sections comprise upper and lower decks interbraced by a three-dimensional lattice.

SUMMARY OF INVENTION

The object of the invention is to provide a new structure facilitating the production of deviators and anchorages for the prestressing cables.

According to the invention there is provided a bridge comprising prefabricated sections, and cables for prestressing externally of concrete of said sections, each section having two, respectively upper and lower, interbraced decks and bracings constituted by longitudinal oblique webs which form dihedrons and at least some of said sections having at least one transverse panel closing said dihedrons, said panels assuring desired deviations of said prestressing cables as well as their anchoring.

Preferably, the transverse panels are situated at the ends of dihedrons.

According to another aspect of the invention there is provided a bridge section comprising two, respectively, upper and lower, decks and longitudinal inclined webs which form dihedrons and constitute bracings between said decks, said dihedrons having their apex edge downwards.

According to a third aspect of the invention there is provided a method of fabrication of a bridge section comprising the steps of:

prefabricating rectangular plates having dimensions appropriate for constituting webs of said section interbracing upper and lower decks of said section, said plates having reinforcements projecting at positions of desired connection of said webs with said decks of said section to form dihedrons having their apex edge downwards and at positions of desired contact of said webs with webs of a preceding section;

arranging said plates on supports, in positions relative to said webs of said section to be obtained;

arranging the necessary shuttering for the casting of said decks and contact zones with the preceding section; and casting said decks and said contact zones.

Various other objects and advantages of the invention will become apparent from the following description with reference to the drawings.

DETAILED DESCRIPTION

Figure 1:
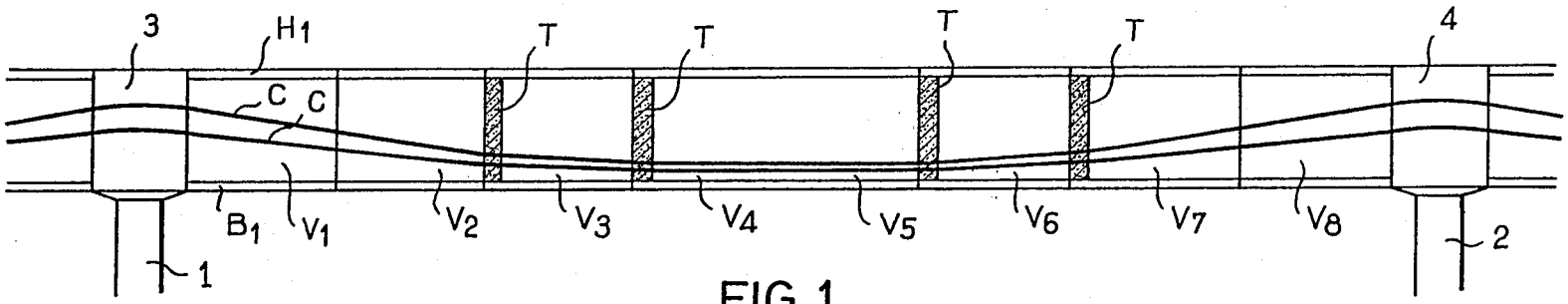
FIG. 1 is a schematic longitudinal cross-section of a span of a bridge in accordance with the present invention.

The running span of the bridge shown in FIG. 1 has, between two piers 1,2 a succession of sections, that is to say prefabricated transverse sections, $V_1$ to $V_8$. Each section has an upper deck H and a lower deck B interbraced by the oblique longitudinal webs. In addition, certain sections $V_3$, $V_4$, $V_6$ and $V_7$ have between their decks transverse panels T.

The words "longitudinal" and "transverse" are applied to elements which extend respectively parallel to the length and parallel to the width of the bridge.

The span is prestressed by cables C which undergo deviations only at the positions of the transverse panels, which are provided precisely for this purpose. At the positions of the pier 1,2 the cables are also deviated in concrete bodies 3,4 in a manner known in itself.

Figure 2:
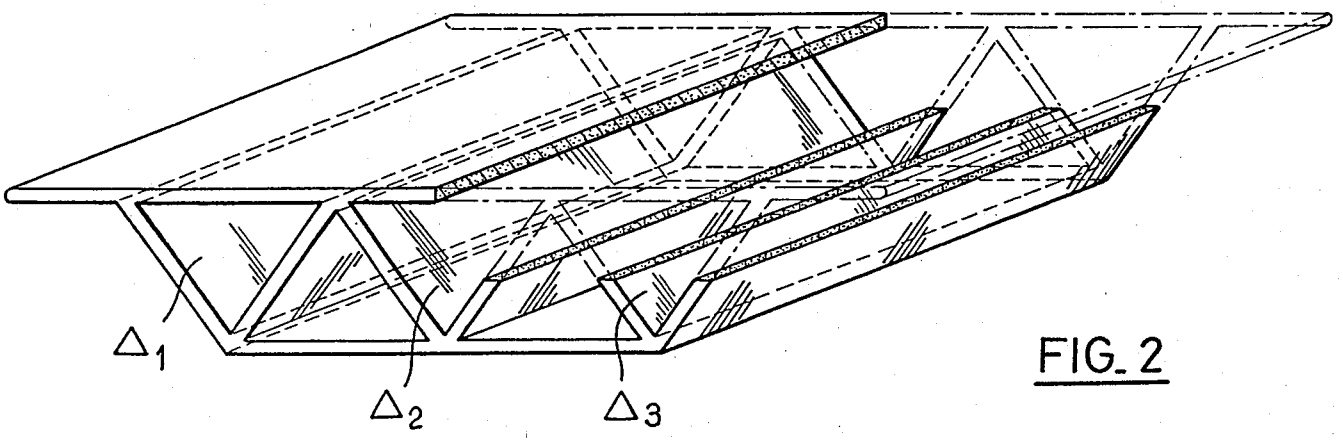
FIG. 2 is a perspective view of a section having no transverse panels.
Figure 10:
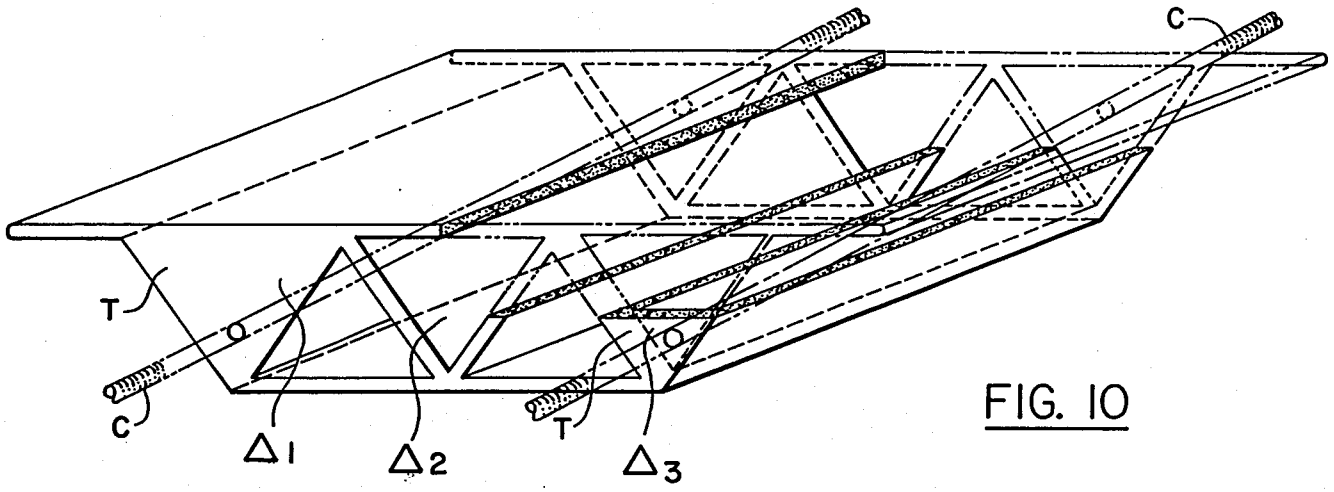
FIG. 10 is a partially broken away perspective view of a section having two transverse panels closing dihedrons separated by (at least) one dihedron with no transverse panel.
Figure 12:
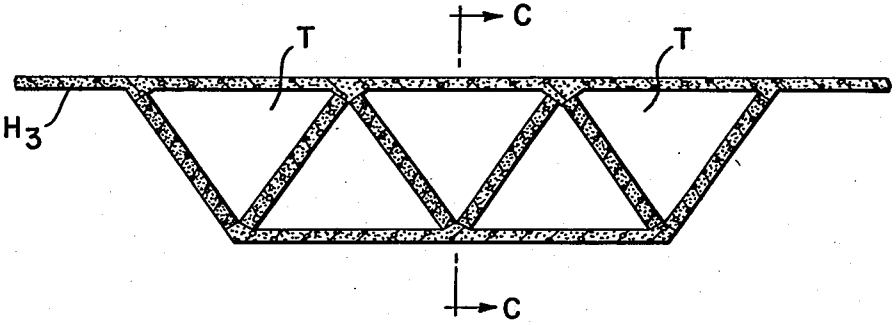
FIGS. 12, 13 and 14 are cross-sections on the lines A—A, B—B and D—D, respectively, in FIG. 11.
Figure 11:
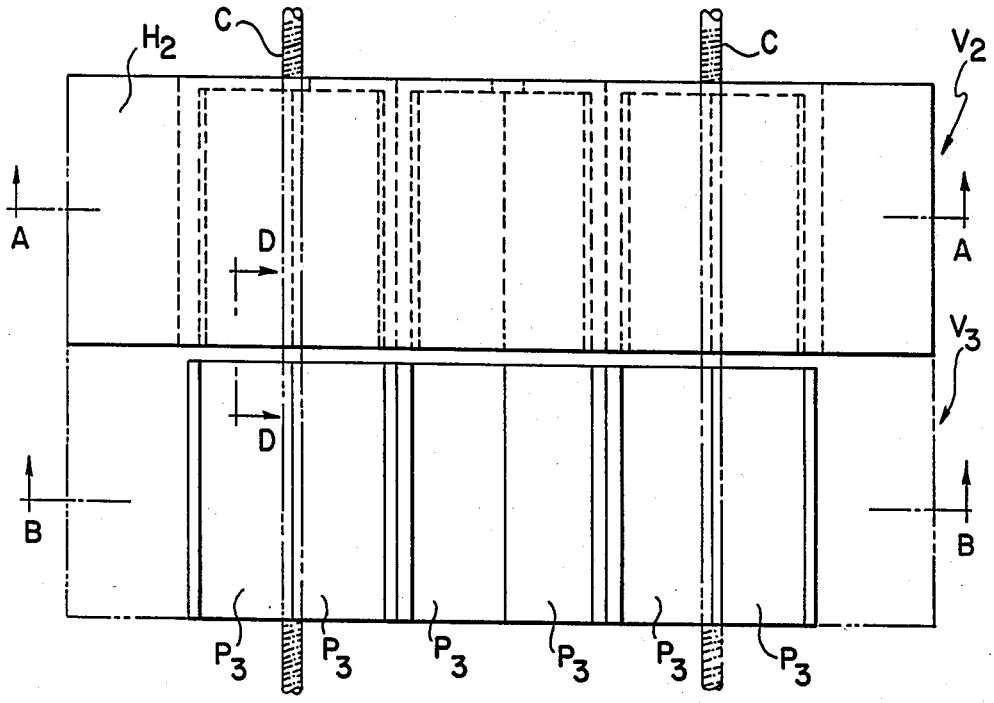
FIG. 11 is a view from above of a succession of two sections according to FIG. 10, one of the sections being already fabricated and the other section being in the course of fabrication.
Figure 13:
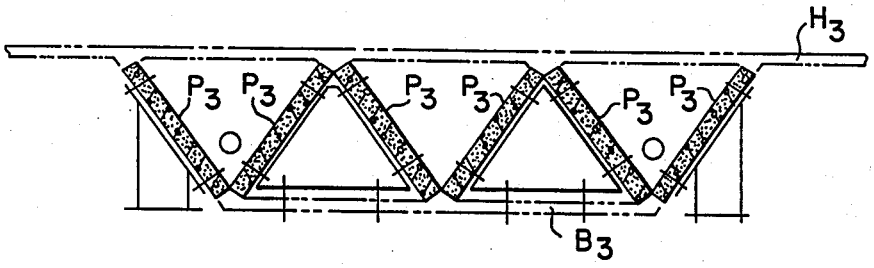
Figure 14:
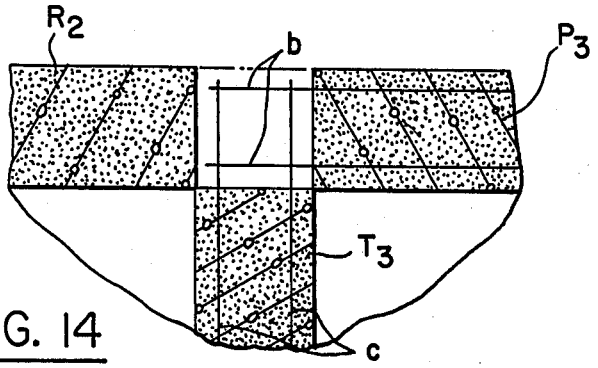
Figure 15:
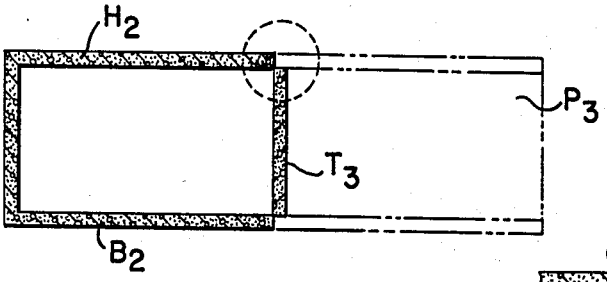
FIG. 15 is a cross-section on the line C—C in FIG. 12.
Figure 16:
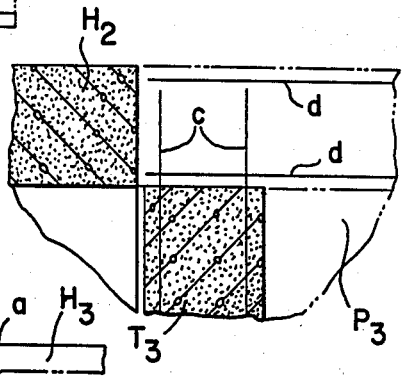
FIG. 16 is a view on a larger scale of the circled part in FIG. 15.
Figure 17:
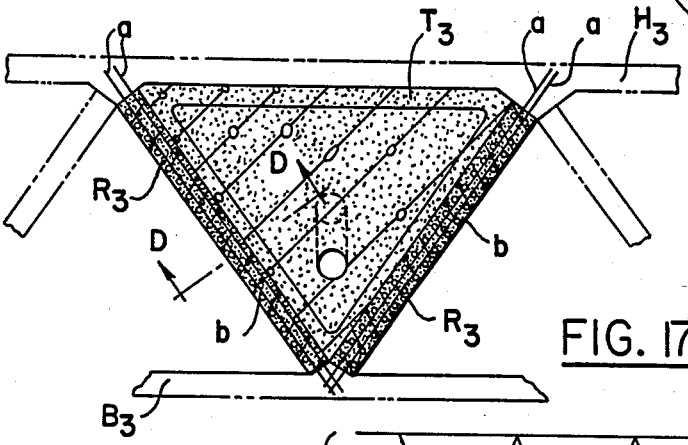
FIG. 17 is a view on a larger scale of a part of FIG. 13 showing waiting reinforcements.
Figure 18:
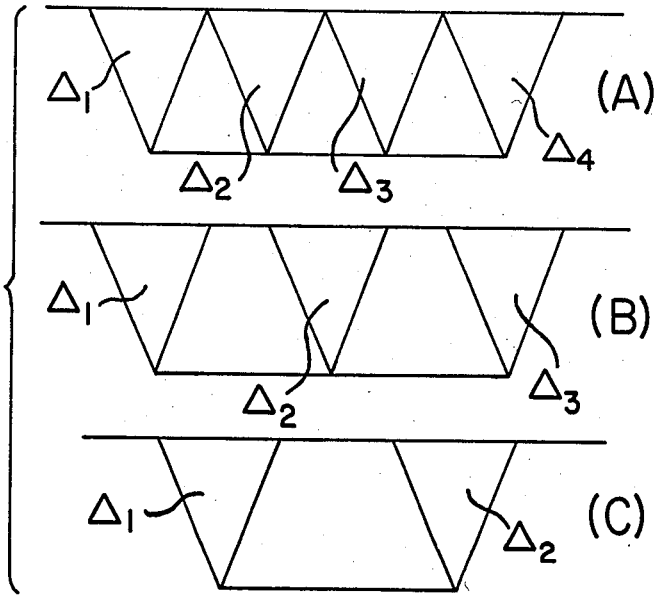
FIG. 18 is a diagram showing in vertical cross-sections variants for the sections.

Each section (FIGS. 2, 10) has an upper deck H and a lower deck B interbraced by concrete webs R oblique with respect to a vertical plane and longitudinal which form a succession of isosceles dihedrons of which the apex edges are situated downwards in the lower deck. As shown, for example, the section has six webs R forming three dihedrons. In this example, the dihedrons are contiguous one after the other. This arrangement is not obliqatory. By way of variant, the dihedrons Δ can be spaced apart. FIG. 18 shows three embodiments in which the dihedrons are adjoining (FIG. 18A) or non-adjoining (FIGS. 18B and 18C). The number of dihedrons is chosen as a function of the width of the bridge and the strength desired, generally two to four dihedrons per section are sufficient. In FIG. 18, the sections have respectively four dihedrons Δ1–Δ4 (FIG. 18A), three dihedrons Δ1–Δ3 (FIG. 18B) and two dihedrons Δ1–Δ2 (FIG. 18C).

In addition, certain sections (FIG. 10) comprise one or more transverse panels or verticals.

For fabricating a running section without a transverse panel one proceeds in the following manner (FIGS. 3 to 9):

(a) Rectangular plates having dimensions appropriate for constituting the webs of the section are prefabricated, these plates having projecting reinforcements at positions of desired connections of the webs with the decks of the section and at positions of desired contacts of these webs with the webs of the preceding section.

(b) These plates are arranged on supports, in the relative positions of the webs of the section to be obtained.

(c) The necessary shuttering for the casting of the decks and the contact zones with the preceding section are arranged, using the preceding section as a counter-mould; and (d) The tables and the contact zones are cast.

Figure 3:
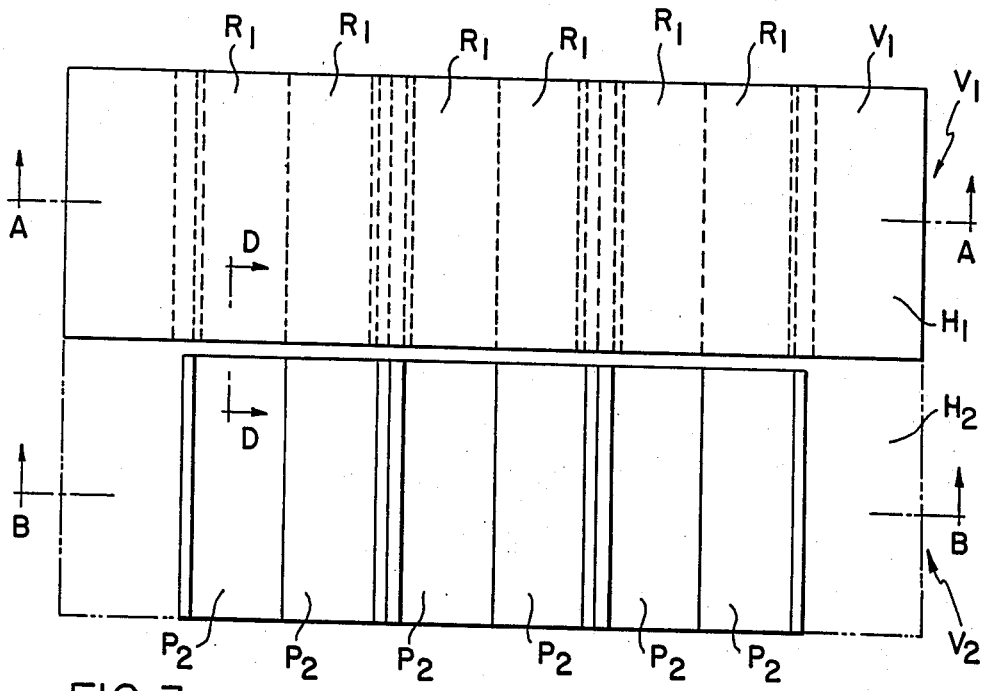
FIG. 3 is a view from above of a succession of two sections according to FIG. 2, one of the sections being already fabricated and the other section being in the process of fabrication.
Figure 4:
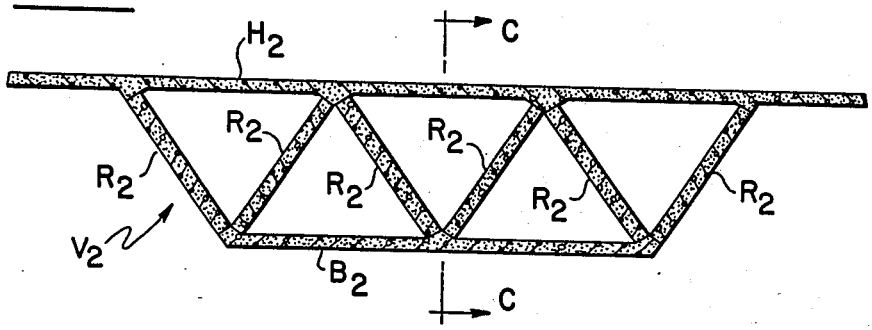
FIGS. 4, 5 and 6 are cross-sections on the lines A—A, B—B and D—D, respectively, in FIG. 3.
Figure 5:
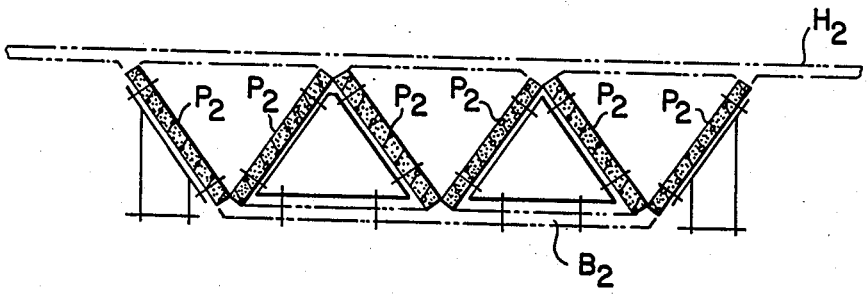
Figure 6:
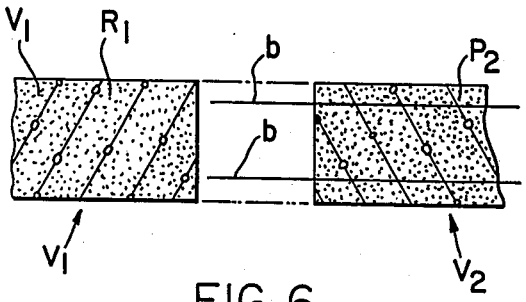
Figure 7:
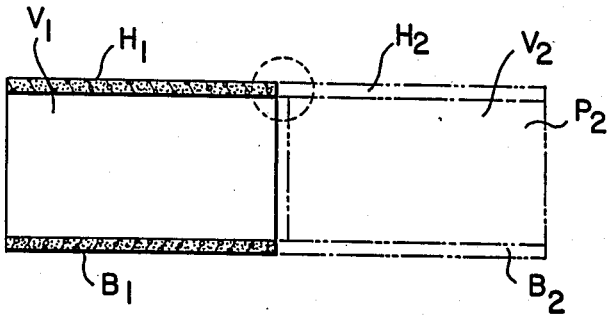
FIG. 7 is a cross-section on the line C—C in FIG. 4.
Figure 8:
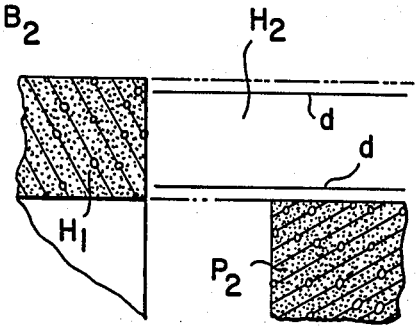
FIG. 8 is a view on a larger scale of the circled part in FIG. 7.
Figure 9:
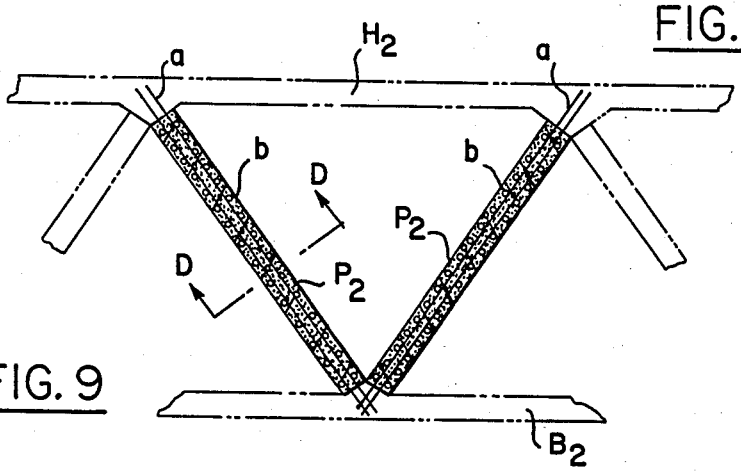
FIG. 9 is a view on a larger scale of a part of FIG. 5 showing waiting reinforcements.

In FIG. 3, the section $V_1$ is seen from above already fabricated and the section $V_2$ in the course of fabrication: the prefabricated plates $P_2$ destined to form the webs $R_2$ of the section $V_2$ are already in place. In FIG. 5 appear the plates $P_2$ on their supports. In FIG. 9, the reinforcements a,b of the waiting plates are shown, on the one hand for connections with the future decks, and on the other hand for casting the edges of the webs which will be in contact with the webs $R_1$ of the section $V_1$. The cross-sections of FIGS. 7, 8, 6 facilitate comprehension of the method. It should be noted in FIGS. 3, 5, 7, 8 and 9, that the decks $H_2$ and $B_2$ of the section $V_2$ are only shown in outline because these decks have not yet been fabricated.

If the section has to comprise one or more transverse panels, preferably vertical, the method is completed by the operations consisting of the prefabrication of triangular plates T having the dimensions of the mentioned transverse panels, these plates having reinforcements projecting laterally, and arranging each triangular plate T in front (that is to say at an end) of the dihedron which the transverse panel is to close, crossing the lateral reinforcements c of the triangular plate with the reinforcements b of the two rectangular plates which constitute the dihedron and the reinforcements d of the decks to be cast.

The shuttering and casting is carried out as in the first case.

It will be noted that, preferably, the triangular plate of the transverse panel is situated at the edge of the counter-mould constituted by the preceding prefabricated section and from which the new section is made.

The transverse sections which serve to deviate the prestressing cables have cable passages and these passages are formed at the required time, during the fabrication of the triangular plate or later, according to the organisation of the site.

FIGS. 11 to 17 are analogous to FIGS. 3 to 9, but concern the fabrication of a section having transverse panels. It has been supposed that it concerns section $V_3$ which is cast using section $V_2$ as a counter-mould (FIGS. 11, 14, 15 and 16).

When the bridge extends in a straight line, each reinforcing cable is preferably arranged in a vertical plane parallel to the axis of the structure. The transverse panels are situated at the positions where the prestressing cables ought to be deviated or fixed.

While there has been shown and described a preferred embodiment of a bridge with prefabricated sections and external prestressing by cables, in accordance with the invention, it will be appreciated that many changes and modifications may be made therein without departing from the essential spirit of the invention as defined by the claims.

I claim:

1. A section for a bridge comprising:

vertically spaced parallel upper and lower decks and longitudinally extending inclined webs which form longitudinally open isosceles dihedrons and constitute integral bracings between said decks, said dihedrons having their apex edge facing downwardly, at least one of said dihedrons being closed by a transverse panel provided with a longitudinal passage for a longitudinal prestressing cable.

2. A section according to claim 1 wherein said dihedrons are contiguous.

3. A section according to claim 1 wherein said dihedrons are spaced apart.

4. A section according to claim 1, wherein said section comprises two to four dihedrons.

5. A section according to claim 1, wherein said transverse panel which closes a dihedron is situated at an end of said dihedron.

6. A section according to claim 1, wherein said section has at least two transverse panels closing two dihedrons respectively, said dihedrons being separated by at least one dihedron which is not provided with a transverse panel.

7. A bridge comprising:

a plurality of prefabricated concrete sections extending longitudinally and in end-to-end relationship, and longitudinally extending cables for prestressing arranged externally of the concrete of said sections, said cables undergoing deviations from the horizontal and each section having vertically spaced parallel and interbraced upper and lower decks, the bracings being constituted by longitudinally extending oblique webs which form longitudinally open dihedrons with the decks and at least some of said sections having at least one substantially vertical transverse panel closing at least one of its respective dihedrons, said transverse panels having longitudinal openings for receiving the prestress cables in longitudinal passage therethrough and for thus establishing said deviations of said prestressing cables from the horizontal.

8. A bridge according to claim 7, wherein each said transverse panel is situated at an end of its dihedron.

9. A bridge according to claim 7, wherein said prestressing cables extend parallel to the length of the bridge.

10. A bridge according to claim 7, wherein said bridge extends in a straight line and each prestressing cable is situtated in a vertical plane parallel to said straight line.

* * * * *